US005269871A

United States Patent [19]

Longworth et al.

[11] Patent Number: 5,269,871

[45] Date of Patent: Dec. 14, 1993

[54] TAPE APPLYING DEVICE

[75] Inventors: Frederic A. Longworth, Afton, Minn.; Robert H. Heil, New Richmond, Wis.

[73] Assignee: Minnesota Mining and Manufacturing Company, St. Paul, Minn.

[21] Appl. No.: 783,277

[22] Filed: Oct. 28, 1991

[51] Int. Cl.[5] ..... B32B 31/00; B65H 19/00; B65H 35/00

[52] U.S. Cl. ..... 156/527; 156/574; 156/579; 156/577; 242/72.1; 242/71.8; 242/72 R; 225/33

[58] Field of Search ..... 225/33, 39; 156/527, 156/523, 574, 579, 577; 242/72 R, 118.5, 118.6, 96, 71.8, 71.9, 68.3, 72.1

[56] References Cited

U.S. PATENT DOCUMENTS

| | | | |
|---|---|---|---|
| Re. 30,787 | 11/1981 | Pool | 156/527 X |
| 1,132,440 | 3/1915 | Pressinet et al. | 242/72.1 X |
| 2,192,634 | 3/1940 | Blomquist | 216/29 |
| 2,486,470 | 11/1949 | Fritzinger | 156/527 |
| 2,493,737 | 1/1950 | Burns | 216/29 |
| 3,017,132 | 1/1962 | Gnage | 242/118.5 X |
| 3,310,452 | 3/1967 | Hartley et al. | 156/523 |
| 3,537,942 | 11/1970 | Kefalos | 156/577 |
| 3,539,418 | 11/1970 | Combs | 156/577 X |
| 3,547,740 | 12/1970 | Hinds | 156/523 |
| 3,658,628 | 4/1972 | Zenter | 156/527 |
| 3,726,537 | 4/1973 | McLoughlin | D34/15 X |
| 3,740,297 | 6/1973 | Vidinsky | 156/523 |
| 3,814,643 | 6/1974 | Wagner | 156/71 |
| 3,814,643 | 6/1974 | Wagner | 156/527 X |
| 3,900,362 | 8/1975 | Schaffer | 156/577 |
| 3,953,758 | 2/1976 | Polzin et al. | 81/3 R |
| 4,037,769 | 7/1977 | Meyers | 242/71.9 X |
| 4,096,021 | 6/1978 | Pool | 156/577 X |
| 4,117,988 | 10/1978 | Moore | 242/71.9 |
| 4,824,517 | 4/1989 | Leahy | 225/33 X |
| 4,845,531 | 10/1985 | Williams | D34/15 X |
| 4,884,734 | 12/1989 | Kahl | 225/33 X |
| 4,915,768 | 4/1990 | Soderburg | 156/527 |
| 4,989,769 | 2/1991 | Longworth | 156/527 X |

FOREIGN PATENT DOCUMENTS

| | | | |
|---|---|---|---|
| 698469 | 11/1964 | Canada | 216/13.3 |
| 1902435 | 10/1964 | Fed. Rep. of Germany . | |
| 1183007 | 12/1964 | Fed. Rep. of Germany . | |
| 1255023 | 11/1967 | Fed. Rep. of Germany . | |
| 872896 | 7/1961 | United Kingdom . | |

*Primary Examiner*—David A. Simmons
*Assistant Examiner*—C. Rainwater
*Attorney, Agent, or Firm*—Gary L. Griswold; Walter N. Kirn; William L. Huebsch

[57] ABSTRACT

A portable device for applying pressure sensitive adhesive coated tape to surfaces including along the top edges of baseboards and the like. The tape applying device includes two generally cylindrical application rollers rotatably mounted on a roller frame in parallel spaced relationship, together with a tape hub adapted to receive a tape roll. The tape hub and the application rollers define portions of first or second paths for tape being unwound from the tape roll with the rear surface of the tape backing disposed partially around the periphery of the first or the second application roller and extending from that to the periphery of the other application roller. Blades are mounted on the roller frame with their cutting edge transverse of portions of the paths between the tape roll and the application rollers, and the device includes manually actuatable means adapted to cause tape moving along one of the paths between the tape roll and one of the application rollers to engage and be transversely cut by the cutting edge of the adjacent blade.

14 Claims, 8 Drawing Sheets

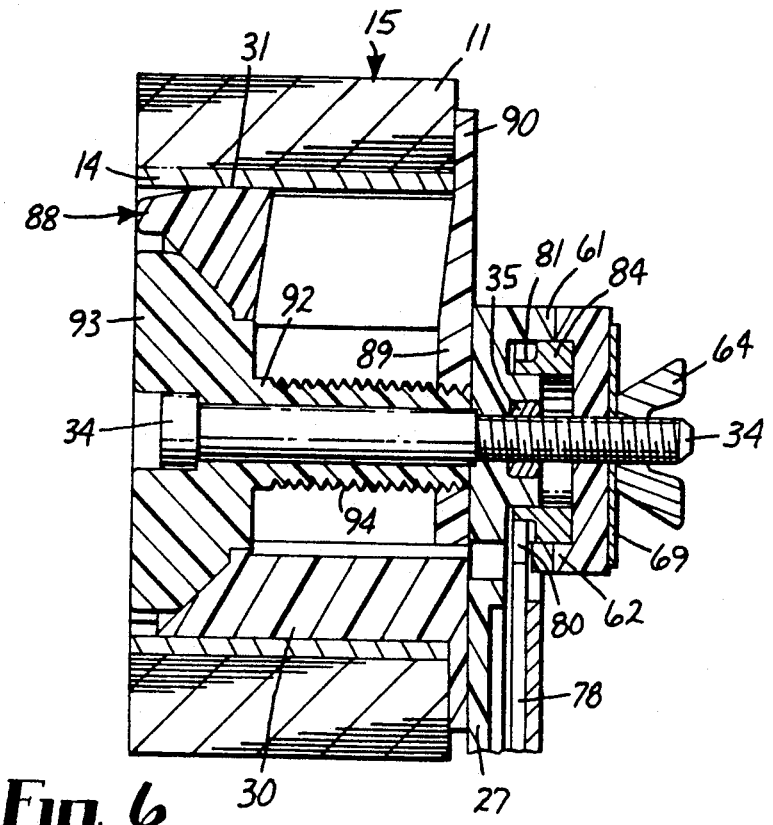
Fig. 6
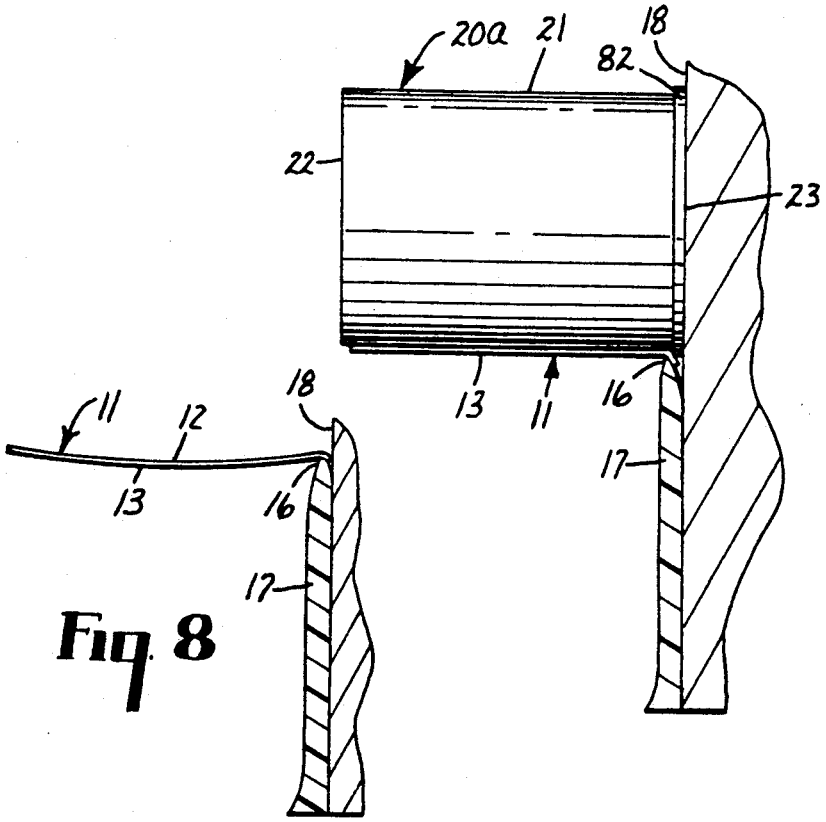
Fig. 7
Fig. 8

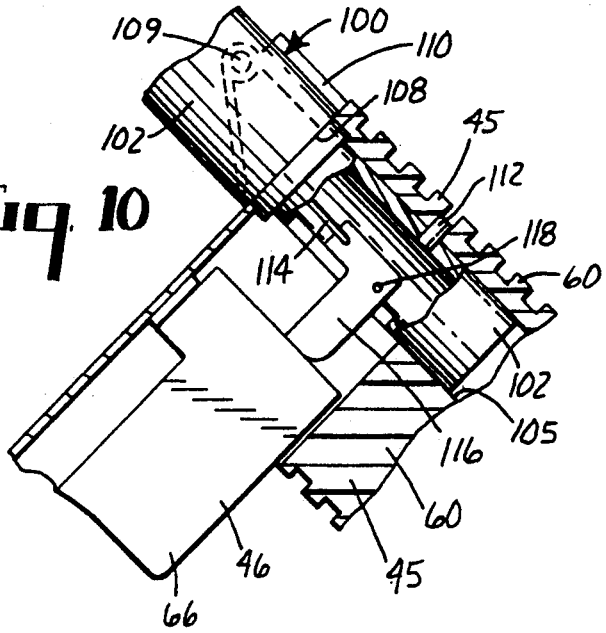
Fig. 10
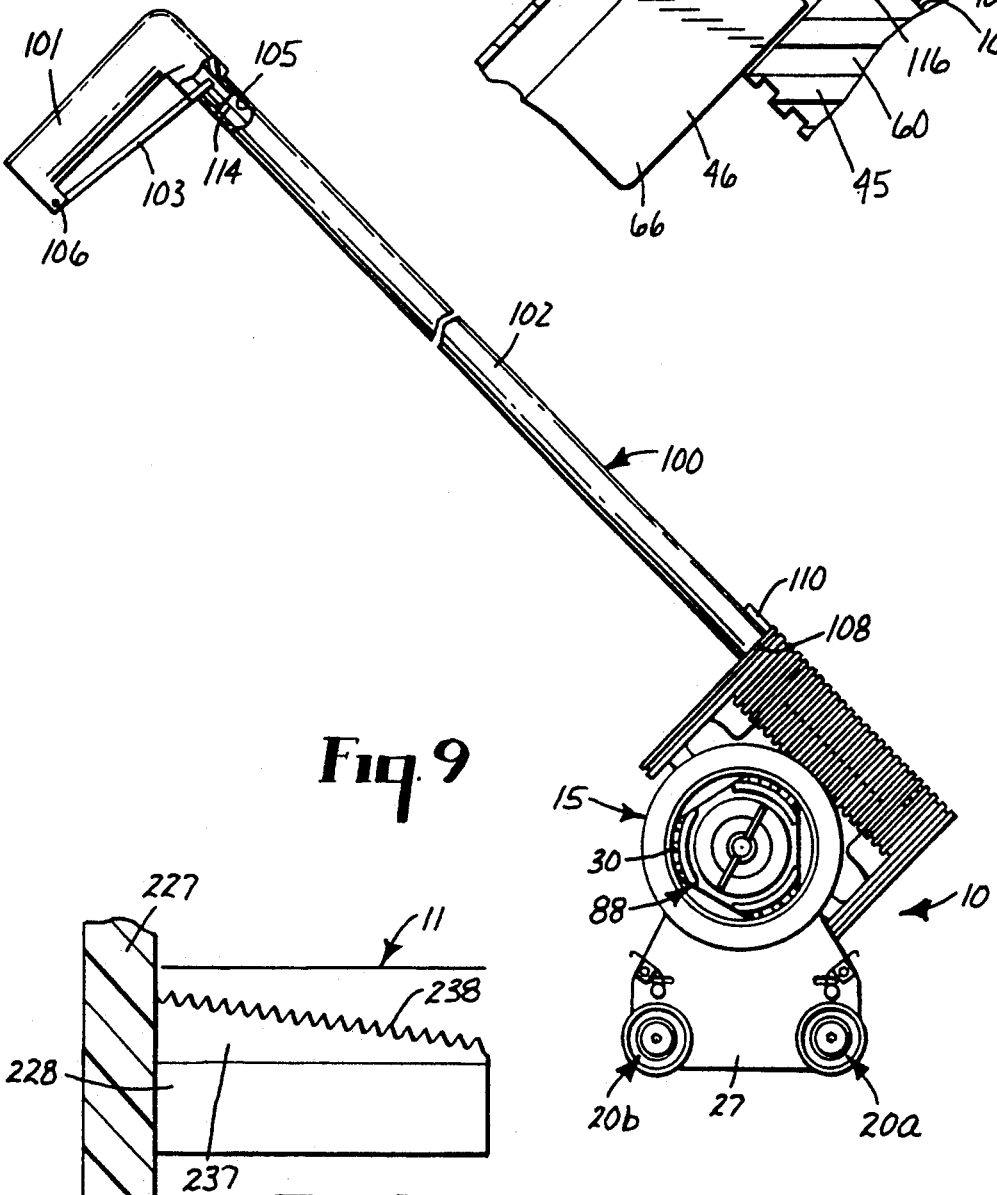
Fig. 9
Fig. 12

TAPE APPLYING DEVICE

TECHNICAL FIELD

The present invention relates to portable devices adapted for use with a supply roll of tape (particularly masking tape) that are adapted to apply the tape to surfaces including along the top edge surfaces of baseboards and the like that are long narrow edge surfaces disposed at about right angles to closely adjacent wall surfaces.

BACKGROUND ART

Portable devices are known that are adapted for use with a supply roll of masking tape and are adapted to apply the tape to surfaces including along the top edge surfaces of baseboards and the like that are long narrow edge surfaces disposed at about right angles to closely adjacent wall surfaces. U.S. Pat. No. 3,900,362 describes such a portable device which includes two generally cylindrical application rollers rotatably mounted on a roller frame in spaced relationship with their axes parallel and ends of the rollers projecting away from the roller frame being generally aligned, and a tape hub having a periphery adapted to be frictionally received coaxially within a central opening in a core of the tape roll is mounted on the roller frame for rotation about its axis which is parallel to the axis of the application rollers, with the tape hub and the application rollers defining portions of a path for the tape being unwound from the tape roll with the rear surface of the backing of the tape from the tape roll disposed partially around the periphery of the first application roller and extending from the periphery of the first application roller to the periphery of the second application roller. The device is intended to be manually grasped and moved along a surface, and the application rollers each have a thin axially outwardly projecting ridge at one end that can engage an edge of structure to which the device is applying the tape to insure that the tape is applied in a desired location on the structure. While that device described in U.S. Pat. No. 3,900,362 is effective for applying tape along surfaces, including along narrow edge surfaces, it does not provide a convenient means for manually engaging the device during such application of tape, and does not provide effective means for severing tape applied to a surface from a supply length of the tape on the device.

Disclosure of Invention

The present invention provides a portable device for conveniently and effectively applying pressure sensitive adhesive coated tape to surfaces including along the edges of baseboards and the like that are long narrow edge surfaces disposed at about right angles to closely adjacent wall surfaces, which device does provide a convenient means for manually engaging the device during such application of tape, and does provide effective means for severing tape applied to a surface from a supply length of the tape on the device.

Generally, the tape applying device according to the present invention includes two generally cylindrical application rollers rotatably mounted on a roller frame in spaced relationship with their axes parallel and ends of the rollers projecting away from the roller frame being generally aligned. A tape hub having a periphery adapted to be frictionally received coaxially within a central opening in a core of the tape roll is mounted on the roller frame for rotation about its axis which is parallel to the axis of the application rollers, with the tape hub and the application rollers defining portions of a first path for the tape being unwound from the tape roll with the rear surface of the backing of the tape from the tape roll disposed partially around the periphery of the first application roller and extending from the periphery of the first application roller to the periphery of the second application roller. A first blade is mounted on the roller frame with its cutting edge transverse of the portion of that path between the tape roll and the first application roller, and the device includes manually actuatable means adapted to cause tape moving along the path between the tape roll and the first application roller to engage and be transversely cut by the cutting edge of the blade. In one embodiment, the blade is disposed along the path, and that manually actuated means includes a blade guard mounted on the roller frame for movement between a normal position at which a tape guide surface on the guard defines a portion of the tape path between the tape roll and the first application roller and guides the tape around the cutting edge of the first blade, and a spaced position with the tape guide surface spaced from the tape path to afford engagement of the tape along the path with the cutting edge of the blade; and means are provided for manually moving the blade guard from its normal position to its spaced position so that the blade will sever an applied length of tape from the supply length of tape.

Preferably the tape hub is mounted so that it and the application rollers can define two different paths for tape being unwound from the tape roll, allowing the device to be moved in either of two opposite directions along a surface to apply the tape thereto, and the device includes a second blade along the second tape path that can be used in the same manner as the first blade to sever an applied length of tape along the second path.

Also, preferably the device includes handle means attached to the roller frame for affording manual manipulation of the portable device that comprises a handle frame including an elongate handle part adapted for manual engagement, and means for attaching the handle frame on the roller frame in any one of many fixed positions; and the means described above for manually moving the blade guard so that the tape will be cut can be operated from a trigger at one end of the handle part.

Other useful features of the device include (1) the application rollers each having a thin axially outwardly projecting ridge at one end that, when the application rollers are attached with the ridges at their distal ends, can be engaged, for example, between baseboard and an adjacent wall to insure that the device applies the tape across the entire narrow top surface of the baseboard; (2) flange portions spaced around and extending radially of the tape hub adapted to locate the side of a the tape roll adjacent the roller frame, and manually adjustable means mounting the flange on the tape hub to position the flange at different desired positions axially of the tape hub to thereby position the sides of different width rolls of tapes in a desired orientation with respect to the distal ends of the application rollers; and (3) provisions for receiving an extension handle assembly having an outer end portion adapted to be manually engaged, and a second end portion adapted to be received and releasably engaged in a bore in the handle, which extension handle assembly can include means at its outer end portion adapted to be manually actuated and coupled to the device to move the blade guard from its normal position to its spaced position upon such actuation so that the blade will sever an applied length of tape from the supply length of tape.

BRIEF DESCRIPTION OF DRAWING

The present invention will be further described with reference to the accompanying drawing wherein like reference numerals refer to like parts in the several views, and wherein:

FIG. 6 is a fragmentary sectional view taken approximately along line 6—6 of FIG. 2;

FIG. 7 is an enlarged fragmentary view illustrating tape being applied by one application roller of the tape applying device of FIG. 1 along the top edge of a baseboard that is disposed at about a right angle to a closely adjacent wall surface;

FIG. 8 is an enlarged fragmentary view illustrating tape after it is applied by the tape applying device of FIG. 1 as illustrated in FIG. 7 along the top edge of the baseboard that is disposed at about a right angle to the closely adjacent wall surface;

FIG. 9 is a reduced side view of the tape applying device of FIG. 1 illustrated in combination with an extension handle assembly releasably engaged with the tape application device, which extension handle assembly has a central part broken away and has a manually engageable end portion on which parts are broken away and sectioned to show details;

FIG. 10 is an enlarged fragmentary view of the portions of the extension handle assembly and the tape application device that are releasably engaged with each other in FIG. 9, which portions have parts broken away and sectioned to show details;

FIG. 12 is a fragmentary sectional view taken approximately along line 12—12 of FIG. 11.

DETAILED DESCRIPTION

Figure 1:
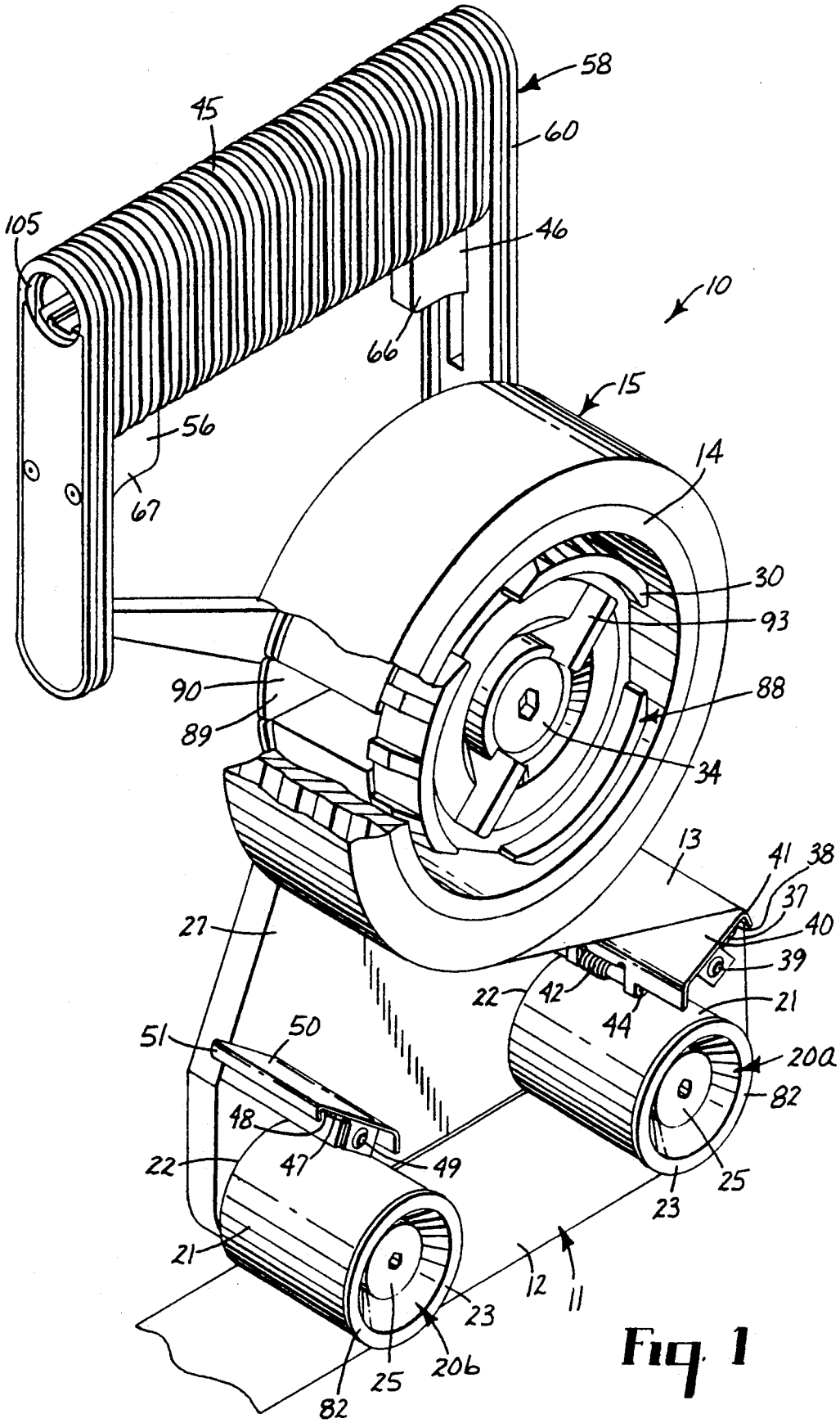
FIG. 1 is a perspective view of a first embodiment of a portable tape applying device according to the present invention illustrating a roll of tape mounted on the device with a portion of the roll broken away to show detail.

Referring now to FIGS. 1 through 8 of the drawing, there is shown a portable tape applying device according to the present invention generally designated by the reference numeral 10.

The portable tape applying device 10 is adapted for use with a supply length of tape 11 (e.g., masking tape) of the type comprising a backing 12 having front and rear surfaces and a layer 13 of pressure sensitive adhesive along its front surface. The tape 11 is helically wound around a core 14 having a central opening with the front surface of the backing 12 innermost to provide a tape roll 15. The device 10 is adapted to apply the tape 11 to surfaces including along a narrow edge surface such as the top surface 16 of a floor molding 17 (see FIGS. 7 and 8) disposed at about a right angle to a closely adjacent surface such as the vertical wall surface 18 illustrated in FIGS. 7 and 8.

Generally, the tape applying device 10 comprises first and second generally identical application rollers **20*a* and 20*b* each having a cylindrical periphery 21, and first and second axially spaced ends 22 and 23. Means in the form of socket head bolts 25 having cylindrical unthreaded portions passing through bearings in the rollers 20*a* and 20*b* and having threaded ends engaged in nuts 26 fixed in a roller frame 27 mount the application rollers 20*a* and 20*b* on the roller frame 27 for rotation about their axes with their axes parallel, the application rollers 20*a* and 20*b* spaced apart, the first ends 22 of the rollers 20*a* and 20*b* adjacent the roller frame 27, and the second ends 23 of the rollers 20*a* and 20*b* projecting away from the roller frame 27 and generally aligned. Also included in the tape applying device 10 is a tape hub 30 having an axis, and a periphery 31 adapted to be frictionally received coaxially within the central opening in the core 14 of the tape roll 15. The tape hub 30 is mounted on the roller frame 27 for rotation about its axis with its axis parallel with the axes of the application rollers 20*a* and 20*b* by means including a socket head bolt 34 having a cylindrical unthreaded portion passing through means defining a bearing for the tape hub 30 and having a threaded end engaged in a nut 35 fixed in the roller frame 27. The tape hub 30 and the application rollers 20*a* and 20*b* define portions of a first path (illustrated in FIGS. 1 and 2) for tape 11 being unwound from the tape roll with the rear surface of the backing 12 of the tape 11 disposed partially around the periphery of the first application roller 20*a* and extending along a common tangent from the periphery of the first application roller 20*a* to the periphery of the second application roller 20*b*. Handle means attached to the roller frame 27 including a manually engageable elongate handle part 45 are provided for affording manual manipulation of the portable device 10 to roll at least the distal end portions of the application rollers 20*a* and 20*b* along tape 11 being unwound from the tape roll 15 and pulled along the first tape path and to apply pressure through the application rollers 20*a* and 20*b* to that tape 11 as it is adhered by movement of the device 10 to a surface along which the rollers 20*a* and 20*b* are moved (e.g., to the narrow top edge surface of the molding 17 disposed at about a right angle to a closely adjacent wall surface 18 as is illustrated in FIG. 7**).

Manually actuatable means that are operated by depressing a trigger 46 at one end of the elongate handle part 45 are provided for cutting tape 11 moving along the first tape path on the device 10 to afford separation of tape 11 being applied to a surface by the device from tape 11 on the tape roll 15. A first blade 37 having a cutting edge 38 adapted to transversely cut the tape 11 is mounting on the roller frame 27 between the tape roll 15 and the first application roller **20*a* by means including a bolt or screw 39 with the cutting edge 38 transverse of the first path and disposed to engage and transversely cut tape 11 moving along the first path. A first blade guard 40 of sheet metal having a convex cylindrically arcuate tape guide surface portion 41 adapted to guide the rear surface of the tape backing 12 has an end opposite its guide surface portion 41 mounting on the roller frame 27 by means including a bolt or screw 44 for pivotal movement between (1) a normal position (illustrated in FIG. 1) to which the blade guard 40 is biased by a spring 42 with the first blade guard 40 lying along one side of the first blade 37 and its tape guide surface portion 41 extending around the cutting edge of the first blade 37, defining a portion of the first tape path between the tape roll 15 and the first application roller 20***a* and guiding the tape 11 around the cutting edge 38 of the first blade, and (2) a spaced position (illustrated in FIG. 2) with the first blade guard 40 spaced from the first blade 37 with its tape guide surface 41 spaced from the first tape path to afford engagement of the tape 11 along the path with the cutting edge 38 of the first blade 37. Means later to be explained that are engageable between the trigger 46 and the first blade guard 40 are provided for manually moving the first blade guard 40 from its normal position to its spaced position against the bias of the spring 42 when the trigger 46 is pressed toward the handle part 45 to afford engagement of the cutting edge 38 of the first blade 37 with the tape 11 being pulled along the first path and applied to a surface to sever a length of tape applied to that surface from the supply length of tape 11 on the tape roll 15.

Figure 2:
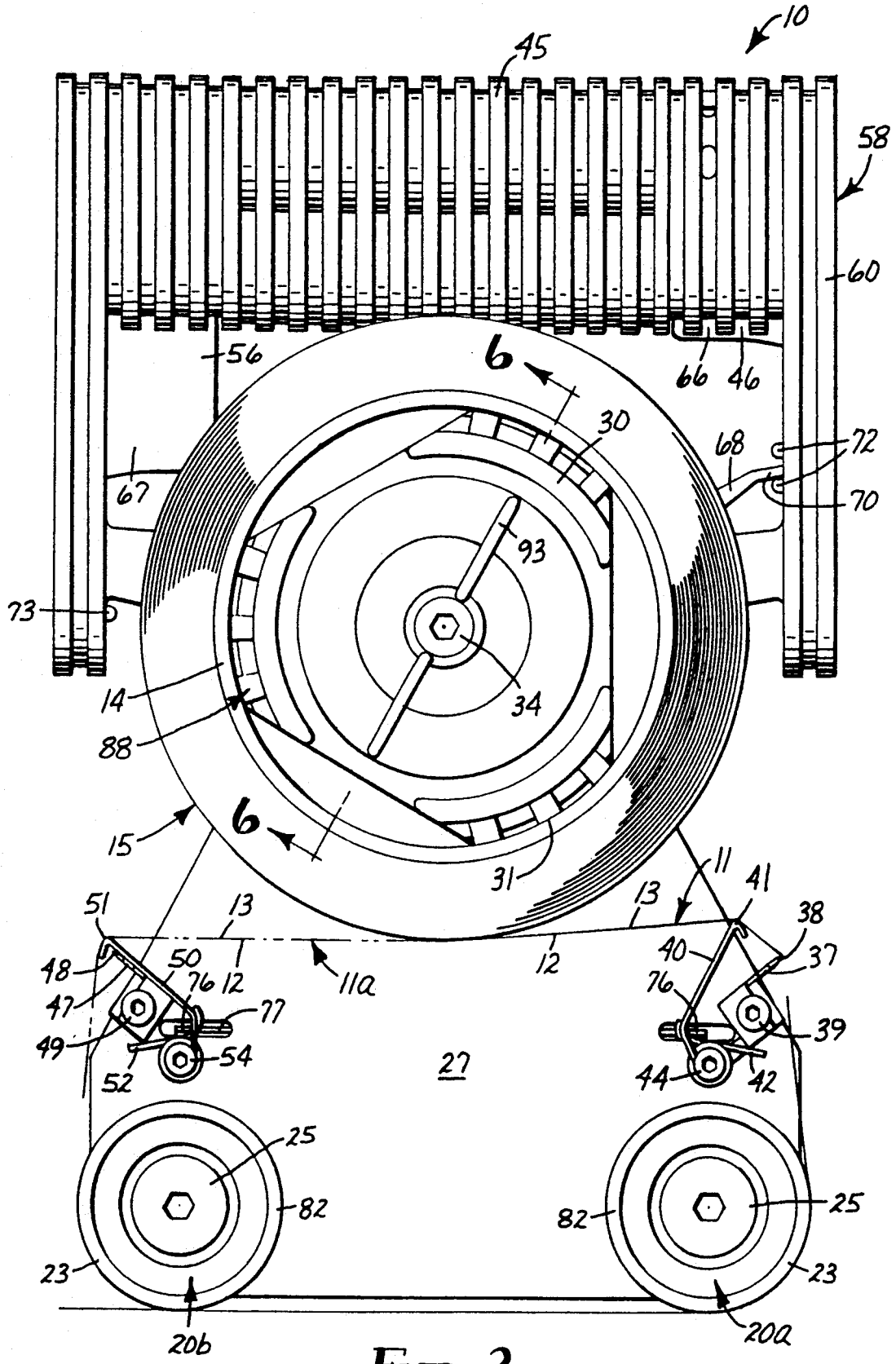
FIG. 2 is a vertical front view of the tape applying device of FIG. 1 illustrating a blade on the device severing tape being applied by the device.
Figure 3:
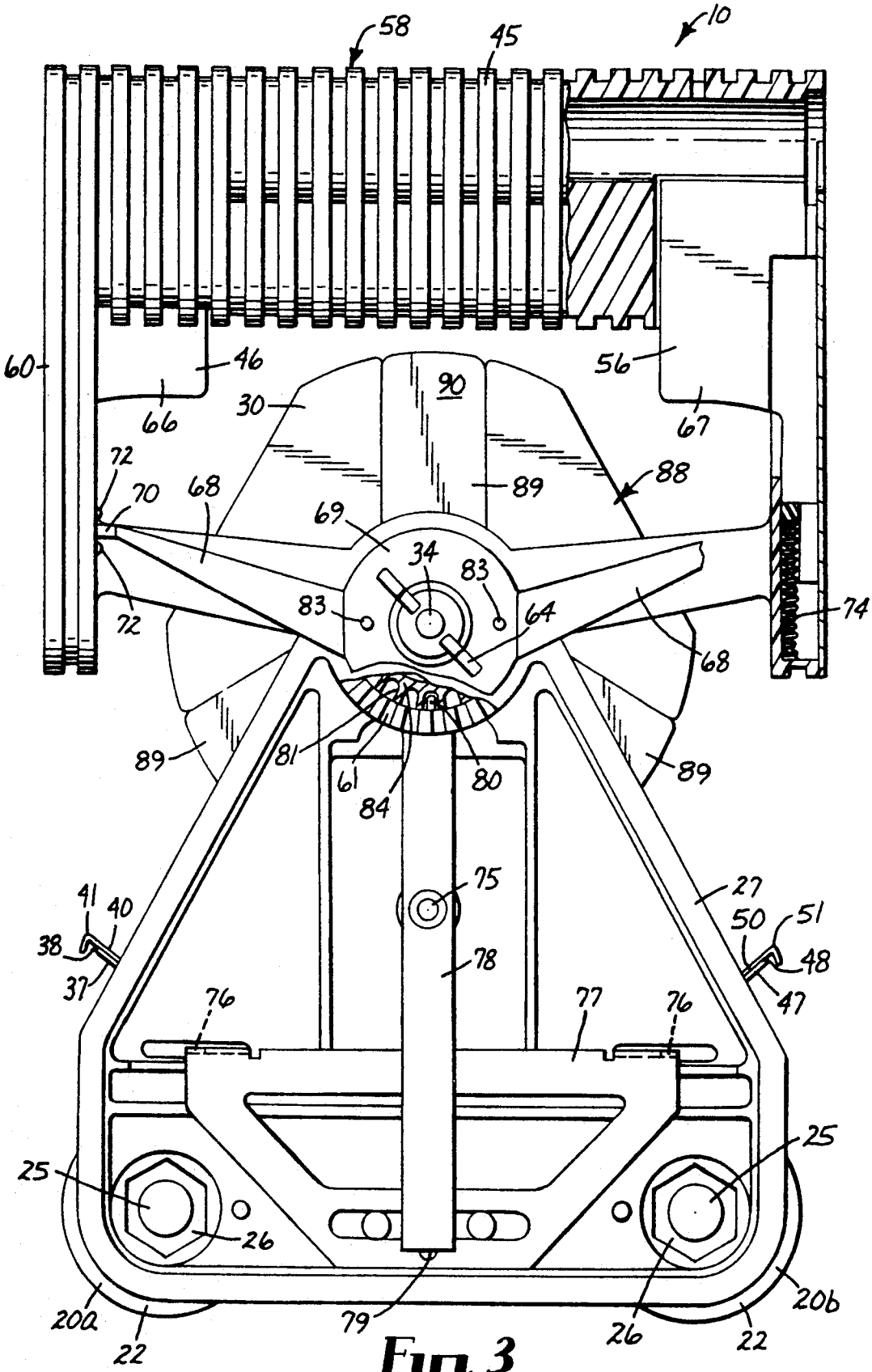
FIG. 3 is a vertical rear view of the tape applying device of FIG. 1 with the tape roll removed, which device has parts removed and broken away to show detail.
Figure 4:
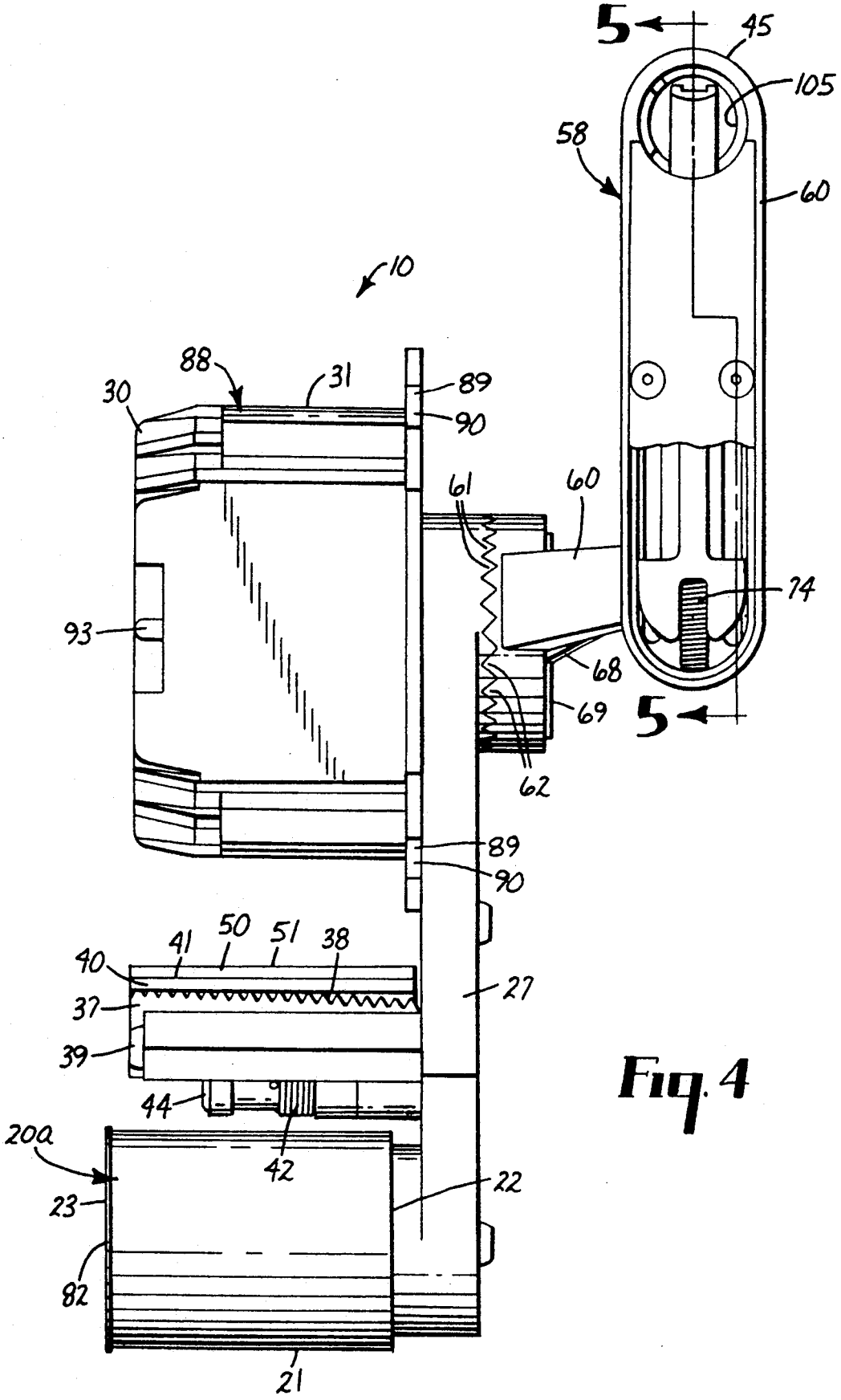
FIG. 4 is a vertical side view of the tape applying device of FIG. 1 with the tape roll removed, which device has parts broken away to show detail.
Figure 5:
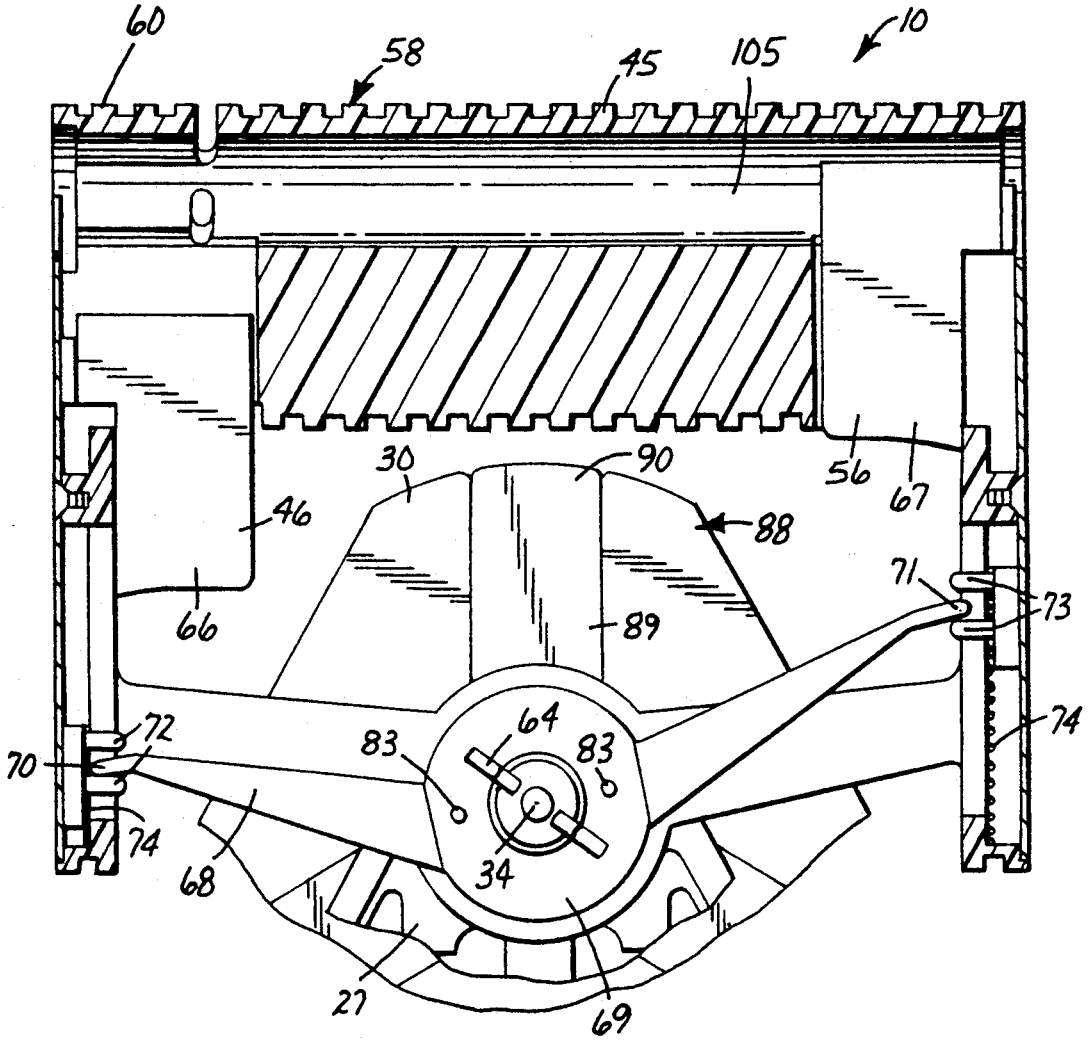
FIG. 5 is a fragmentary sectional view taken approximately along line 5—5 of FIG. 4.

The tape hub 30 is mounted on the roller frame 27 equidistant from both application rollers 20*a* and 20*b* so that the tape hub 30 and the first and second application rollers 20*a* and 20*b* also define portions of a second path for tape 11 being unwound from the tape roll 15 (the second path being illustrated by the dotted line 11*a* in FIG. 2) with the rear surface of the backing 12 of the tape 11 disposed partially around the periphery of the second application roller 20*b* and extending along a common tangent from the periphery of the second application roller 20*b* to the periphery of the first application roller 20*a*. Alternate use of either the first tape path or the second tape path on the device 10 (which only requires changing the side of the tape roll 15 that is adjacent the roller frame 27 and positioning the tape along the appropriate tape path) allows the device 10 to be moved in either of two directions to apply tape to a surface disposed at about a right angle to a closely adjacent surface. The device 10 further includes a second blade 47 having a cutting edge 48 adapted to transversely cut the tape 11; means including a socket head bolt 49 mounting the second blade 47 on the roller frame 27 with the cutting edge 48 transverse of the second path and disposed to engage and transversely cut the tape moving along the second path between the tape roll 15 and the second application roller 20*b*; a second blade guard 50 having a arcuate cylindrically convex tape guide surface portion 51 adapted to guide the rear surface of the tape backing 12 along the second path; and means including a socket head bolt 54 mounting the second blade guard 50 on the roller frame 27 for movement between (1) a normal position illustrated in FIGS. 1 and 2 to which the second blade guard 50 is biased by a spring 52 with the tape guide surface 51 defining a portion of the second tape path between the tape roll 15 and the second application roller 20*b* and guiding the tape 11 around the cutting edge 48 of the second blade 47, to a spaced position with the tape guide surface 51 spaced from the tape path to afford engagement of tape 11 along the second path with the cutting edge 48 of the second blade 47; all of which is the mirror image of but otherwise has the same structure as and is mounted in the same way as the first blade 37 and the first blade guard 40 described above. Also, means later to be explained that are operated by depressing a second trigger 56 at the end of the elongate handle part 45 opposite the first trigger 46 are provided for manually moving the second blade guard 50 from its normal position to its spaced position against the bias of the spring 52 to afford engagement of the cutting edge 48 of the second blade 47 with the tape 11 being pulled along the second path and applied to that surface to sever a length of tape applied to that surface from the supply length of tape 11 on the tape roll 15.

The handle means attached to the roller frame 27 for affording manual manipulation of the portable device 10 is adaptable to afford manual manipulation of the portable device 10 to roll at least the distal end portions of the application rollers 20*a* and 20*b* along tape 11 being pulled along either the first path or the second path and adhered by the device 10 to a surface. The handle means comprises a handle assembly 58 including a handle frame 60 including the elongate handle part 45 which has a longitudinal axis and is adapted for manual engagement, and means for attaching the handle frame 60 on the roller frame 27 in any one of many fixed positions relative to the roller frame 27, in each of which many fixed positions the axis of the elongate handle part 45 is disposed along an imaginary plane disposed at a right angle with respect to the axes of the application rollers 20*a* and 20*b*. The means for attaching the handle frame 60 on the roller frame 27 in any one of many fixed positions comprises a ring of generally triangular projecting first teeth 61 on the roller frame 27 which are disposed about a first tooth ring axis parallel to the axis of the application rollers and concentric with the axis of the tape hub 30; and a ring of generally triangular projecting second teeth 62 formed on the handle frame 60 about a second tooth ring axis coaxial with the first tooth ring axis. The second teeth 62 are sized and disposed to nest between the first teeth 61 on the roller frame 27 in any one of many positions (e.g., 15 degree increments) with the first and second tooth rings coaxial to provide the many fixed positions of the handle frame 60 relative to the roller frame 27. Manually releasable means in the form of a threaded end on the bolt 34 and a wing nut 64 threadably engaged with it that are coaxial with the tooth rings attach the roller frame 27 and handle frame 60 together with the teeth 61 and 62 in the tooth rings nested together in one of the fixed positions. The orientation between the application rollers 20*a* and 20*b* and the elongate handle part 45 on the handle frame 60 can be easily changed to any of the many orientations afforded by nesting together of the tooth rings by loosening the wing nut 64, separating the rings of teeth 61 and 62, rotating the handle frame 60 around the bolt 34 relative to the roller frame 27, and then tightening the wing nut 64 to again engage the rings of teeth 61 and 62 to hold the handle and roller frames 60 and 27 in the desired relationship.

The means that are engageable between the first trigger 46 and the first blade guard 40 for manually moving the first blade guard 40 from its normal position to its spaced position against the bias of the spring 42 when the first trigger 46 is pressed toward the handle part 45, and the means that are engageable between the second trigger 56 and the second blade guard 50 for manually moving the second blade guard 50 from its normal position to its spaced position against the bias of the spring 52 when the second trigger 56 is pressed toward the handle part 45 include means for affording engagement of the triggers 46 and 56 with the blade guards 40 and 50 in any one of the many fixed positions that the handle frame 60 may be positioned with respect to the roller frame 27. The triggers 46 and 56 are each mounted in sockets on the handle frame for sliding reciprocal movement between (1) normal positions (see FIGS. 1 and 3) with manually engageable portions 66 and 67 respectively projecting at opposite ends from the handle part 45 in positions at which they may be engaged by a users index finger, (2) retracted positions (see the first trigger 46 in FIG. 2 and the second trigger 56 in FIG. 5) with their manually engageable portions 66 and 67 retracted within the sockets in the handle part 45, to which retracted positions the triggers 46 and 56 may be pulled by a users index finger, and (3) extended positions (see the second trigger 56 in FIG. 2 and the first trigger 46 in FIG. 5) with the manually engageable portions 66 or 67 projecting farther beyond the sockets in the handle part 45 than in their normal positions. A pivotal connecting link 68 has a circular central portion 69 mounted for pivotal movement around the bolt 34, and projecting portions projecting in generally opposite directions and having distal ends 70 and 71 received in sockets in the triggers 46 and 56 defined between spaced projecting drive lugs 72 and 73 that are opposed portions of the triggers 46 and 56. The connecting link 68 thus connects the triggers 46 and 56 so that both triggers 46 and 56 may be positioned in their normal positions to which the triggers 46 and 56 are biased by springs 74 between the triggers 46 and 56 and the handle frame 60, and so that when one trigger 46 or 56 is moved to its retracted position the other trigger 46 or 56 will be moved by pivoting of the link 68 about the bolt 34 to its extended position, and so that when one trigger 46 or 56 is moved to its extended position the other trigger 46 or 56 will be moved by pivoting of the link 68 to its retracted position. A driven plate 77 (FIG. 3) is mounted on the roller frame 27 for sliding movement in a direction at right angles to and in a plane parallel to the axes of the rollers **20*a* and 20*b* from a central position with tab like portions 76 of the plate 77 projecting through slots in the roller frame 27 and spaced slightly from the first and second blade guards 40 and 50 to allow them to be positioned in their normal positions under the influence of the springs 42 and 52, in one direction (see FIG. 2) toward the second roller 20*b* so that one of the tab like portions 76 will engage and move the first blade guard 40 to its spaced position, and in the other direction toward the first roller 20*a* so that the other of the tab like portions 76 will engage and move the second first blade guard 50 to its spaced position. An elongate pivot member 78 is mounted for pivotal movement around a pin 75 on the roller frame 27, has a drive lug 79 at one end that projects through a central opening in the driven plate 77, and has a driven lug 80 projecting axially from its opposite end that is spaced a predetermined distance from the axis of the bolt 34. The central portion 69 of the pivot link 68 is attached by screws 83 to a circular gear like member 84 mounted in an annular groove in the handle frame 60 for rotation coaxially around the bolt 34. The gear like member 84 has a circular array 81 of openings each adapted to receive the driven lug 80 to afford driving engagement between the pivot link 68 and the gear like member 84 and thereby the pivot member 78 when the pivot link 68 is pivoted by a user moving one of the triggers 46 or 56 to its retracted or extended position. Thus, the driven lug 80 will be positioned in one of the array 81 of openings in the gear like member 84 to afford such driving engagement in any one of the many fixed positions that the handle frame 60 may be positioned on the roller frame 27. When the first trigger 46 is manually pressed into the elongate handle part 45 by a users index finger, the pivot link 68 and pivot member 78 will be pivoted, thereby moving the driven plate 77 so that the lug like portion 76 of the driven plate 77 adjacent the first roller 20*a* moves the first blade guard 40 adjacent the first roller 20*a* to its spaced position, allowing tape 11 moving along the first tape path to engage and be severed by the cutting edge 38 on the first blade 37. Similarly, when the second trigger 56 is manually pressed into the elongate handle part 45 by a users index finger, the pivot link 68 and pivot member 78 will be pivoted, thereby moving the driven plate 77 so that the lug like portion 76 of the drive plate 77 adjacent the second roller 20*b* moves the second blade guard 50 adjacent the second roller 20*b* to its spaced position, allowing tape 11 moving along the second tape path to engage and be severed by the cutting edge 48 on the second blade 47**.

The cylindrical peripheries 21 of the first and second application rollers **20*a* and 20*b* are defined by thin tubular resiliently elastic flexible layers of polymeric material (e.g., about 0.030 inch or 0.076 centimeter thick layers of 20 to 60 durometer material) included in the rollers 20*a* and 20*b* and extending to the first ends 22 of the rollers 20*a* and 20*b*. Preferably, as illustrated, the first and second application rollers 20*a* and 20*b* have thin (e.g., in the range of about 0.050 to 0.030 inch or 0.127 to 0.076 centimeter wide) axially outwardly projecting ridges 82 defined by rigid disks at their second ends 23 and projecting radially outwardly of their cylindrical peripheries 21 by a short distance (e.g., in the range of 0 to 0.010 inch or 0 to 0.025 centimeter). The ridges 82 are useful when the device 10 is used to apply tape 11 along a narrow top edge surface such as the top surface 16 of a polymeric floor molding 17 disposed at about a right angle to a closely adjacent vertical wall surface 18 as is illustrated in FIGS. 7 and 8, in that the ridges 82 engage between the top portion of the molding 17 and the wall surface 18 to guide the rollers 20*a* and 20*b* and ensure that the edge of the tape fully covers and partially wraps around the top edge surface 16. Surprisingly, masking tape 11 so applied by the device 10 has been found after application to project at about a right angle from the wall surface 18 as is illustrated in FIG. 8 with the applied masking tape 11 slightly cylindrically concave longitudinally along its upper surface. This is advantageous as the applied masking tape 11 then serves as an awning like structure to also protect the side surface of the molding from drips of paint being applied to the wall surface 18 above, or allows a user to position masking material along the side surface of the molding and then bend the masking tape 11** into engagement with it to insure protection of the molding and the adjacent floor from such drips of paint.

The bolts 25 that provide the means for mounting the application rollers **20*a* and 20*b* on the roller frame 27 for rotation about their axes are removable from the nuts 26 to afford reversing the rollers 20*a* and 20*b* so that the ridges 82 at the second ends 23 of the rollers 20*a* and 20*b* are adjacent the roller frame 27, and the first ends 22 of the rollers 20*a* and 20*b* project away from the roller frame 27 and are generally aligned should that be desirable to apply the tape 11** to certain types of surfaces such as the top surfaces of wood baseboard.

The device 10 includes means for positioning the outer sides of different width tape rolls 15 that may be positioned on the tape hub 30 in a desired orientation (e.g., in alignment) with respect to the outer or second ends 23 of the application rollers 20*a* and 20*b* to afford applying the outer edge of the tape at a desired position along a substrate. The tape hub 30 is a part of a hub assembly 88 that further includes a movable portion 89 mounted for axial movement on the hub 30 and including three spaced flange portions 90 around and extending radially outwardly of the tape hub 30. The flange portions 90 are adapted to locate the side of the tape roll 15 that is adjacent the roller frame 27 axially along the hub 30. Manually adjustable means are provided for mounting the movable portion 89 to afford positioning the flange portions 90 at different desired positions axially of the tape hub 30 to thereby position the outer sides of different width tape rolls 15 in a desired orientation with respect to the second ends 23 of the application rollers 20*a* and 20*b*. That manually adjustable means comprises surfaces on the hub 30 that receive and afford relative sliding movement of the movable portion 89 axially of the hub 30; a shaft 92 included in the hub assembly 88 that is positioned coaxially with the hub 30 and movable portion 89, is rotatably mounted on the bolt 34 while being prevented by the bolt 34 and roller frame from moving axially with respect to the bolt 34, and has the hub 30 and movable portion 89 supported on its periphery with the hub 30 at a fixed location relative to the axis of the shaft 92. The shaft 92 has a manually engageable end portion 93 at the end of the hub 30 opposite the roller frame 27 and has external threads 94 engaging internal threads on the movable portion 89 to define the position of the movable portion 89 and thereby the flange portions 90 axially of the hub 30 and to cause axial movement of the movable portion 89 and flange portions 90 axially of the hub 30 upon rotation of the threaded shaft 92 caused by manual manipulation of the manually engageable end portion 93. A user can rotate the manually engageable end portion 93 in either direction to move the flange portions 90 axially of the hub, and thereby position them at any location that will locate the outer edge of the tape roll 15 at a desired location axially of the hub 30 to align the edge of the tape 11 applied by the device 10 at a desired location relative to the outer or second ends 23 of the rollers 20*a* and 20*b*.

The device 10 can optionally also include an extension handle assembly 100 (see FIGS. 9 and 10) including means for releasably engaging the handle frame 60 and a manually engageable handle portion 101 at its first or outer end projecting radially from a elongate tubular portion 102 of the handle assembly by which the extension handle assembly 100 and thereby the device 10 attached to it may be manually manipulated. The extension handle assembly 100 is useful so that a user can propel the device to apply tape along the upper surface of baseboard molding from a standing position. The extension handle assembly 100 includes means adapted to be manually actuated at its first or outer end by squeezing an actuating lever 103 toward the handle portion 101 for moving one of the trigger members 46 or 56 from its normal position to its retracted position to cause severing of the tape 11 moving along one of the tape paths.

The elongate handle part 45 of the handle frame 60 has a generally coaxial bore 105 having an outlet openings through the handle frame 60 at both ends. The elongate tubular portion 102 of the extension handle assembly 100 has a second end portion opposite the handle portion 101 adapted to be received in the bore 105 in the handle frame 60 through either one of its outlet openings, and the handle frame 60 and the extension handle assembly 100 include means for releasably engaging the second end portion of the extension handle assembly 100 in the handle frame 60 adjacent either end of the bore 105. The means for releasably engaging include a generally L-shaped slot recessed from the inner surface of the handle frame 60 defining the bore 105 at both ends of the bore 105, either of which L-shaped slots are adapted to receive the end of a pin 106 projecting radially from the second end portion of the handle assembly 100. An axially extending portion of the L-shaped slot is initially enterable by the pin 106 on the second end portion when the handle portion 101 at the first end of the handle assembly 100 is rotated out of alignment with the handle frame 60, and a radially extending portion of the L-shaped slot at the inner end of its axially extending portion is subsequently enterable by the pin 106 by rotating the handle portion 101 into alignment with the frame portion 60. After the pin 106 has thus entered the radially extending portion of the L-shaped slot, the second end portion of the handle assembly 100 will be held in the handle frame 60 by engagement of the pin 106 with the walls defining the slot and engagement of a shoulder 108 on the handle assembly 100 with the outer surface of the handle frame 60. The handle assembly 100 is then releasably held in its portion with the handle portion 101 aligned with the handle frame 60 by a locking lug 110. The locking lug 110 is pivotably mounted about a pin 109 on the tubular portion 102 of the handle assembly 100 and is biased by a spring portion of the lug 110 for movement radially of the tubular portion 102 into a slot in the handle frame 60 to hold the handle portion 101 in alignment with the handle frame 60. An end portion of the locking lug 110 is accessible to be manually depressed into the handle assembly 100 and allow the handle assembly 100 to be manipulated relative to the handle frame 60 to allow movement of the pin 106 out of the L-shaped slot and thereby movement of the handle end portion out of the bore 105. The actuating lever 103 included in the means adapted to be manually actuated by squeezing the actuating lever 103 toward the handle portion 102 to move one of the trigger members 46 or 56 from its normal position to its retracted position is pivotably mounted by a pin 112 on the distal end of the handle portion 101 and has an end in the tubular portion 102 of the handle assembly 100 to which is attached a wire 114. The end of the wire 114 opposite the actuating lever 103 is attached to an L-shaped actuating cam 116 pivotably mounted about a pin 118 adjacent the second end of the handle assembly 100 and movable by pulling the actuating lever 103 toward the handle portion 101 from a normal position recessed within the tubular portion 102, to an extending position with an end projecting out of the tubular portion 102, with such movement causing the actuating cam 116 to engage and move the adjacent trigger 46 or 56 from its normal to its extended portion, thereby actuating the means for severing tape moving along the tape path in the manner described above.

Figure 11:
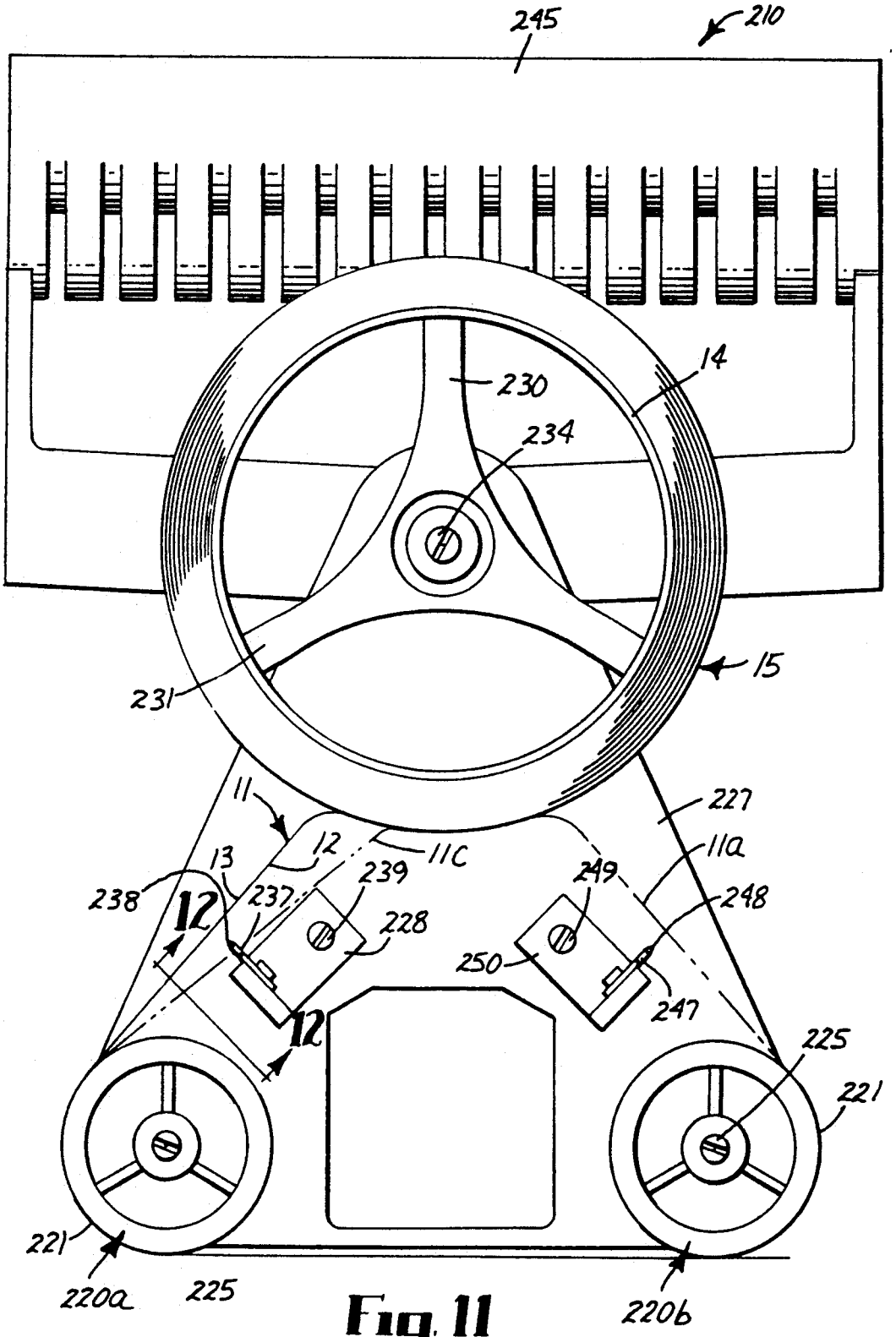
FIG. 11 is a front elevational view of a second embodiment of a portable tape applying device according to the present invention.

Referring now to FIGS. 11 and 12 of the drawing, there is shown a second embodiment of a portable tape applying device according to the present invention generally designated by the reference numeral 210.

Like the device 10, the portable tape applying device 210 is adapted for use with a supply length of tape 11 (e.g., masking tape) of the type comprising a backing 12 having front and rear surfaces and a layer 13 of pressure sensitive adhesive along its front surface. The tape 11 is helically wound around a core 14 having a central opening with the front surface of the backing 12 innermost to provide a tape roll 15. Like the device 10, the device 210 is adapted to apply the tape 11 to surfaces including along a narrow edge surface such as the top surface 16 of a floor molding 17 (see FIGS. 7 and 8) disposed at about a right angle to a closely adjacent surface such as the vertical wall surface 18 illustrated in FIGS. 7 and 8.

Generally, the tape applying device 210 comprises first and second generally identical application rollers 220*a* and 220*b* each having a cylindrical periphery 221, and first and second axially spaced ends; which rollers 220*a* and 220*b* are essentially identical to the rollers 20*a* and 20*b* of the device 10 described above. Means in the form of bolts 225 passing through bearings in the rollers 220*a* and 220*b* and having threaded ends engaged in nuts fixed in a roller frame 227 mount the application rollers 220*a* and 220*b* on the roller frame 227 for rotation about their axes with their axes parallel, the application rollers 220*a* and 220*b* spaced apart, the first ends of the rollers 220*a* and 220*b* adjacent the roller frame 227, and the second ends of the rollers 220*a* and 220*b* projecting away from the roller frame 227 and generally aligned. Also included in the tape applying device 210 is a tape hub 230 having an axis, and a periphery 231 adapted to be frictionally received coaxially within the central opening in the core 14 of the tape roll 15. The tape hub 230 is mounted on the roller frame 227 for rotation about its axis with its axis parallel with the axes of the application rollers 220*a* and 220*b* by means including a bolt 234 having a portion passing through means defining a bearing for the tape hub 230 and having a threaded end engaged in a nut fixed in the roller frame 227. The tape hub 230 and the application rollers 220*a* and 220*b* define portions of a first path (illustrated by a solid line in FIG. 11) for tape 11 being unwound from the tape roll with the rear surface of the backing 2 of the tape 11 disposed partially around the periphery of the first application roller 220*a* and extending along a common tangent from the periphery of the first application roller 220*a* to the periphery of the second application roller 220*b*. Handle means attached to the roller frame 227 including a manually engageable elongate handle part 245 are provided for affording manual manipulation of the portable device 210 to roll all or at least the distal end portions of the application rollers 220*a* and 220*b* along tape 11 being unwound from the tape roll 15 and pulled along the first tape path and to apply pressure through the application rollers 220*a* and 220*b* to that tape 11 as it is adhered by movement of the device 10 to a surface along which the rollers 220*a* and 220*b* are moved.

Manually actuatable means that are operated by manually stopping rotation of the tape roll 15 and hub 230 while continuing to move the device 210 so that the rollers 220*a* and 220*b* continue to roll along tape being applied to a surface are provided for cutting tape 11 moving along the first tape path on the device 10 to afford separation of tape 11 being applied to a surface by the device from tape 11 on the tape roll 15. A first blade 237 having a cutting edge 238 adapted to transversely cut the tape 11 is mounting on the roller frame 227 between the tape roll 15 and the first application roller 220*a* by means including a bracket 228 attached to the frame 227 by a bolt or screw 239 with the cutting edge 238 transverse of the first path and disposed (1) to be spaced from the first tape path between the tape roll 15 and the first application roller 220*a* when both the tape roll 15 and the rollers 220*a* and 220*b* are allowed to freely rotate as tape 11 along the first tape path is being applied to a surface, and (2) to be engaged by the tape 11 when rotation of the tape roll 15 relative to the roller frame 227 is manually stopped while the device is being moved so that the rollers 220*a* and 220*b* continue to freely rotate and move along tape 11 being applied to a surface. Such engagement of the cutting edge 238 of the blade 237 by the tape is caused by the increasing tension in the tape 11 between the first roller 220*a* and the tape roll 15 after rotation of the tape roll 15 is stopped and movement of the device 210 continues. That increase in tension then causes the tape 11 to be pulled from the periphery of the roll 15 toward a more tangential path with respect to the roll 15 (that more tangential path being illustrated by dotted outline 11*c*) than the tape normally assumes along the first tape path by separation of the adhesive on the tape 11 from the underlying wrap of tape 11 on the roll 15, with the cutting edge 238 of the blade 237 being positioned so that it is engaged as the tape moves toward that more tangential path 11*c*. As can be seen in FIG. 12, the cutting edge 238 of the blade 237 is defined by a row of rather sharp spaced projecting teeth upon which tape moving toward that more tangential path is impaled, with the ends of the teeth defining the cutting edge 238 being disposed at a slight angle (e.g., about 10 degrees) with respect to the major surfaces of the tape along the path so that after rotation of the roll 15 is stopped the tape 11 will be pulled onto the teeth and progressively transversely severed by the cutting edge 238 as the portion along of the tape 11 along the rollers 220*a* and 220*b* continues to be applied to the surface.

The tape hub 230 is mounted on the roller frame 227 equidistant from both application rollers 220*a* and 220*b* so that the tape hub 230 and the first and second application rollers 220*a* and 220*b* also define portions of a second path for tape 11 being unwound from the tape roll 15 (the second path being illustrated by the dotted line 11*a* in FIG. 11) with the rear surface of the backing 12 of the tape 11 disposed partially around the periphery of the second application roller 220*b* and extending along a common tangent from the periphery of the second application roller 220*b* to the periphery of the first application roller 220*a*. Alternate use of either the first tape path or the second tape path on the device 210 (which only requires changing the side of the tape roll 15 that is adjacent the roller frame 227 and positioning the tape along the appropriate tape path) allows the device 210 to be moved in either of two directions to apply tape to a surface disposed at about a right angle to a closely adjacent surface. The device 210 further includes a second blade 247 having a cutting edge 248 mounted on the roller frame 227 by means including a bracket 250 attached to the frame 227 by a bolt or screw 249 with the cutting edge 248 transverse of the second path and disposed to engage and transversely cut the tape moving along the second path between the tape roll 15 and the second application roller 220*b* by the same means and in the same manner described above for cutting the tape moving along the first path by the first blade 237.

The handle means including the elongate handle part 245 can be adjustable with respect to the roller frame 227 by the same means and in the same manner that the handle means of the device 10 is adjustable with respect to the roller frame 27. That handle frame can also be adapted to be engaged by an extension handle assembly generally of the type described above with reference to FIGS. 9 and 10. Additionally, the tape hub 230 can be replaced by the adjustable tape hub assembly 88 described above on the device 10, should that be desired.

The present invention has now been described with reference to two embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

What is claimed is:

1. A portable device adapted for use with a supply length of tape of the type comprising a backing having front and rear surfaces and a layer of pressure sensitive adhesive along said front surface, the tape being helically wound around a core having a central opening with said front surface of said backing innermost to provide a tape roll, the device being adapted to apply the tape to surfaces including along a narrow edge surface disposed at about a right angle to a closely adjacent surface and comprising:

a roller frame;

first and second application rollers having axes, cylindrical peripheries around said axes, and first and second axially spaced ends;

means mounting said application rollers on said roller frame for rotation about said axes with said axes parallel, said application rollers spaced apart, said first ends of said rollers adjacent said roller frame, and said second ends of said rollers projecting away from said roller frame and being generally aligned;

a tape hub having an axis, and a periphery adapted to be frictionally received coaxially within the central opening in the core of the tape roll;

means mounting said tape hub on said roller frame for rotation about the axis of said tape hub with the axis of said tape hub parallel with the axes of said application rollers, with said tape hub and said application rollers defining portions of a first tape path for the tape being unwound from the tape roll with the rear surface of the backing of the tape disposed partially around the periphery of said first application roller and extending from the periphery of said first application roller to the periphery of said second application roller;

a first blade having a side surface and a cutting edge at one end of said side surface adapted to transversely cut the tape;

means mounting said first blade on said roller frame with said cutting edge transverse of said first tape path and disposed to engage and transversely cut the tape moving along the first tape path between the tape roll and said first application roller;

a first blade guard including a planar portion and an arcuate portion having a convex cylindrically arcuate tape guide surface portion adapted to guide the rear surface of the tape backing;

means mounting the end of said first blade guard opposite said arcuate portion on said roller frame for pivotal movement of said first blade guard between a normal position with said planar portion lying along said side of said first blade and said arcuate portion and said tape guide surface extending around the cutting edge of the first blade to define a portion of said first tape path between the tape roll and said first application roller and to guide said tape around the cutting edge of said first blade, and a spaced position with said arcuate portion and said tape guide surface spaced from the cutting edge to afford engagement of the tape along the first tape path with the cutting edge of the first blade;

handle means attached to said roller frame for affording manual manipulation of said portable device to roll at least the distal end portions of said application rollers along tape being pulled along said first tape path and adhered by the device to a narrow edge surface disposed at about a right angle to a closely adjacent surface; and means for manually moving said blade guard from said normal position to said spaced position to afford engagement of the cutting edge of the blade with the tape being pulled along the first tape path and applied to the narrow edge surface into to sever an applied length of tape from the supply length of tape;

said means mounting said tape hub on said roller frame mounts said tape hub so that said tape hub and said first and second application rollers also define portions of a second tape path for the tape being unwound from the tape roll with the rear surface of the backing of the tape disposed partially around the periphery of said second application roller and extending from the periphery of said second application roller to the periphery of said first application roller; and said device further includes:

a second blade having a side surface and a cutting edge at one end of said side surface adapted to transversely cut the tape;

means mounting said second blade on said roller frame with said cutting edge transverse of said second tape path and disposed to engage and transversely cut the tape moving along the second tape path between the tape roll and said second application roller;

a second blade guard including a planar portion and an arcuate portion having a convex cylindrically arcuate tape guide surface portion adapted to guide the rear surface of the tape backing; and means mounting the end of said second blade guard opposite said arcuate portion on said roller frame for pivotal movement of said second blade guard between a normal position with said planar portion lying along said side of said second blade and said arcuate portion and said tape guide surface extending around the cutting edge of the second blade to define a portion of said second tape path between the tape roll and said second application roller and to guide said tape around the cutting edge of said second blade, and a spaced position with said tape guide surface spaced from the cutting edge to afford engagement of the tape along the second tape path with the cutting edge of the second blade;

said handle means is adapted to afford manual manipulation of said portable device to roll at least the distal end portions of said application rollers along tape being pulled along either said first tape path or said second tape path and adhered by the device to a narrow edge surface disposed at about a right angle to a closely adjacent surface; and said device includes means for manually moving said second blade guard from said normal position to said spaced position to afford engagement of the cutting edge of the second blade with the tape being pulled along the second tape path and applied to the narrow edge surface to sever an applied length of tape from the supply length of tape.

2. A portable device according to claim 1, wherein said handle means attached to said roller frame for affording manual manipulation of said portable device comprises a handle assembly including a handle frame including an elongate handle part having a longitudinal axis and adapted for manual engagement, and means for attaching said handle frame on said roller frame in any one of many fixed positions relative to said roller frame, in each of which many fixed positions the axis of said elongate handle part is disposed along an imaginary plane disposed at a right angle with respect to the axes of said application rollers, said device includes spring means for biasing said first and second blade guards to said normal positions, and said means for manually moving said blade guards from said normal positions to said spaced positions comprises a first trigger mounted on said handle frame at one end of said handle part for movement between a normal position with a manually engageable portion of said first trigger projecting from one end of said handle part, and a retracted position with at least a portion of said manually engageable portion within said handle part, means between said first trigger and said first blade guard in any one of said many fixed positions of said handle frame on said roller frame for moving said first blade guard from said normal position to said spaced position in opposition to said biasing means upon manual movement of said first trigger from said normal position to said retracted position, and a second trigger mounted on said handle frame at the end of said handle part opposite said first trigger for movement between a normal position with a manually engageable portion of said second trigger projecting from said handle part, and a retracted position with at least a portion of said manually engageable portion of said second trigger within said handle part, and means between said second trigger and said second blade guard in any one of said many fixed positions of said handle frame on said roller frame for moving said second blade guard from said normal position to said spaced position in opposition to said biasing means upon manual movement of said second trigger from said normal position to said retracted position.

3. A portable device according to claim 2 wherein said means for attaching said handle frame on said roller frame in any one of many fixed positions comprises a ring of projecting first teeth on said roller frame, said first teeth being disposed about a first tooth ring axis parallel to the axis of said application rollers, a ring of projecting second teeth on said handle frame, said second teeth being disposed about a second tooth ring axis at a right angle to said imaginary plane and being adapted to nest between the first teeth on said roller frame in many positions with said tooth rings coaxial to provide said many fixed positions of said handle frame relative to said roller frame, and manually releasable means extending coaxial of said tooth rings for attaching said roller frame and handle frame together with said teeth in said tooth rings nested together in one of said fixed positions; and said means between said first and second triggers and said first and second blade guards in any one of said many fixed positions of said handle frame on said roller frame includes first linkage means mounted for relative movement on said roller frame, adapted to engage said blade guards, and having a drive tab spaced a predetermined distance from said first tooth axis, and a linkage member supporting said first and second triggers and mounted for pivotal movement on said handle frame about said second tooth ring axis between said normal and retracted positions of said first and second triggers, said linkage member having a circular array of openings each adapted to receive said drive tab and afford driving engagement between said linkage member and said first linkage means.

4. A portable device according to claim 1 wherein said first and second application rollers have thin axially outwardly projecting ridges at said second ends projecting radially outwardly of said cylindrical peripheries.

5. A portable device according to claim 1 wherein said first and second application rollers have thin axially outwardly projecting ridges at said second ends projecting radially outwardly of said cylindrical peripheries, said cylindrical peripheries are defined by a thin cylindrical resiliently flexible layer of polymeric material included in said roller, said cylindrical periphery extends to the first ends of said rollers, and said means for mounting said application rollers on said roller frame for rotation about said axes affords reversing said rollers so that said second ends of said rollers are adjacent said roller frame, and said first ends of said rollers project away from said roller frame and are generally aligned.

6. A portable device according to claim 4 further including a movable member mounted on said hub and comprising a flange around and extending radially of said tape hub adapted to locate the side of a said tape roll adjacent the roller frame, and manually adjustable means for moving said movable member relative to said hub to position said flange at different desired positions axially of said tape hub to thereby position the sides of different width rolls of tapes in a desired orientation with respect to the second ends of the application rollers.

7. A portable device according to claim 6 wherein said manually adjustable means for positioning said flange at different desired positions axially of said tape hub comprises means mounting said movable member on said hub for relative sliding movement axially of said hub, a threaded shaft having an axis and a manually engageable end portion, means mounting said shaft with said manually engageable end portion at the end of said hub opposite said roller frame for rotation relative to said hub while restricting axial movement of said shaft relative to said hub, said movable member having threads engaging the threads on said threaded shaft to define the position of said flange axially of said hub and to cause axial movement of said flange axially of said hub upon rotation of said threaded shaft caused by manual manipulation of said manually engageable end portion.

8. A portable device according to claim 2 wherein said elongate handle part of said handle frame has a generally coaxial through bore having a first outlet opening adjacent said first trigger, and a second outlet opening adjacent said second trigger, said device further includes an extension handle assembly having an outer end portion adapted to be manually engaged, and a second end portion adapted to be received in the bore in said handle through either of said outlet openings, said handle frame and extension handle assembly include means for releasably engaging the second end portion of said extension handle assembly in said handle frame with said extension handle extending through either of said outlet openings, and said extension handle assembly includes means adapted to be manually actuated at said outer end portion for moving said first trigger from said normal position to said retracted position when said extension handle extends through said outlet opening adjacent said second trigger, and for moving said second trigger from said normal position to said retracted position when said extension handle extends through said outlet opening adjacent said first trigger.

9. A portable device adapted for use with a supply length of tape of the type comprising a backing having front and rear surfaces and a layer of pressure sensitive adhesive along said front surface, the tape being helically wound around a core having a central opening with said front surface of said backing innermost to provide a tape roll, the device being adapted to apply the tape to surfaces and comprising:

a roller frame;

a first application roller having an axis, a cylindrical periphery around said axes, and first and second axially spaced ends;

means mounting said application roller on said roller frame for rotation about said axis with said first end of said roller adjacent said roller frame, and said second end of said roller projecting away from said roller frame;

a tape hub having an axis, and a periphery adapted to be frictionally received coaxially within the central opening in the core of the tape roll;

means mounting said tape hub on said roller frame for rotation about the axis of said tape hub with the axis of said tape hub parallel with the axis of said application roller, with said tape hub and said application roller defining portions of a first tape path for the tape being unwound from the tape roll with the rear surface of the backing of the tape disposed partially around the periphery of said first application roller;

a first blade having a cutting edge adapted to transversely cut the tape;

means mounting said first blade on said roller frame along said first tape path between the tape roll and said first application roller with said cutting edge transverse of said first tape path;

a first blade guard having a tape guide surface portion adapted to guide the rear surface of the tape backing;

means mounting said first blade guard on said roller frame for movement between a normal position with said tape guide surface defining a portion of said first tape path between the tape roll and said first application roller and guiding said tape around the cutting edge of said first blade, to a spaced position with said tape guide surface spaced from the cutting edge to afford engagement of the tape along the first tape path with the cutting edge of the first blade; and manually actuatable means for manually moving said blade guard from said normal position to said spaced position to afford engagement of the cutting edge of the blade with the tape being pulled along the first tape path and applied to the surface to sever an applied length of tape from the supply length of tape;

said manually actuatable means includes a handle assembly attached to said roller frame for affording manual manipulation of said portable device, said handle assembly including a handle frame including an elongate handle part having a longitudinal axis and adapted for manual engagement, and means for attaching said handle frame on said roller frame in any one of many fixed positions relative to said roller frame, in each of which many fixed positions the axis of said elongate handle part is disposed along an imaginary plane disposed at a right angle with respect to the axes of said application roller, said means for attaching said handle frame on said roller frame in any one of many fixed positions comprising a ring of projecting first teeth on said roller frame, said first teeth being disposed about a first tooth ring axis parallel to the axis of said application rollers, a ring of projecting second teeth on said handle frame, said second teeth being disposed about a second tooth ring axis at a right angle to said imaginary plane and being adapted to nest between the first teeth on said roller frame in many positions with said tooth rings coaxial to provide said many fixed positions of said handle frame relative to said roller frame, and manually releasable means extending coaxial of said tooth rings for attaching said roller frame and handle frame together with said teeth in said tooth rings nested together in one of said fixed positions; and said manually actuatable means for manually moving said blade guard from said normal position to said spaced position comprises a trigger mounted on said handle frame for movement between a normal position and a retracted position, and means between said trigger and said blade guard in any one of said many fixed positions of said handle frame on said roller frame for moving said blade guard from said normal position to said spaced position in opposition to said biasing means upon manual movement of said trigger from said normal position to said retracted position.

10. A portable device according to claim 9 further including a movable member mounted on said hub and comprising a flange around and extending radially of said tape hub adapted to locate the side of a said tape roll adjacent the roller frame, and manually adjustable means for moving said movable member relative to said hub to position said flange at different desired positions axially of said tape hub to thereby position the sides of different width rolls of tapes in a desired orientation with respect to the second ends of the application rollers.

11. A portable device according to claim 9 wherein said elongate handle part of said handle frame has a generally coaxial bore having an outlet opening, said device further includes an extension handle assembly having an outer end portion adapted to be manually engaged, and a second end portion adapted to be received in the bore in said handle through said outlet opening, said handle frame and extension handle assembly include means for releasably engaging the second end portion of said extension handle assembly in said handle frame.

12. A portable device adapted for use with a supply length of tape of the type comprising a backing having front and rear surfaces and a layer of pressure sensitive adhesive along said front surface, the tape being helically wound around a core having a central opening with said front surface of said backing innermost to provide a tape roll, the device being adapted to apply the tape to surfaces and comprising:

a roller frame;

a first application roller having an axis, a cylindrical periphery around said axes, and first and second axially spaced ends;

means mounting said application roller on said roller frame for rotation about said axis with said first end of said roller adjacent said roller frame, and said second end of said roller projecting away from said roller frame;

a tape hub having an axis, and a periphery adapted to be frictionally received coaxially within the central opening in the core of the tape roll;

means mounting said tape hub on said roller frame for rotation about the axis of said tape hub with the axis of said tape hub parallel with the axis of said application roller, with said tape hub and said application roller defining portions of a first tape path for the tape being unwound from the tape roll with the rear surface of the backing of the tape disposed partially around the periphery of said first application roller;

a first blade having a cutting edge adapted to transversely cut the tape;

means mounting said first blade on said roller frame along said first tape path between the tape roll and said first application roller with said cutting edge transverse of said first tape path; and manually actuatable means adapted to cause tape moving along said path between the tape roll and said first application roller to engage and be transversely cut by the cutting edge of the blade;

said device further including a movable member mounted on said tape hub and comprising a flange around and extending radially of said tape hub adapted to locate the side of a said tape roll adjacent the roller frame, and manually adjustable means for moving said movable member relative to said tape hub to position said flange at different desired positions axially of said tape hub to thereby position the sides of different width rolls of tapes in a desired orientation with respect to the second end of the application roller.

13. A portable device according to claim 12 wherein said manually adjustable means for positioning said flange at different desired positions axially of said tape hub comprising means mounting said movable member on said tape hub for relative sliding movement axially of said tape hub, a threaded shaft having an axis and a manually engageable end portion, means mounting said shaft with said manually engageable end portion at the end of said tape hub opposite said roller frame for rotation relative to said tape hub while restricting axial movement of said shaft relative to said tape hub, said movable member having threads engaging the threads on said threaded shaft to define the position of said flange axially of said tape hub and to cause axial movement of said flange axially of said tape hub upon rotation of said threaded shaft caused by manual manipulation of said manually engageable end portion.

14. A portable device according to claim 9 wherein said means between said trigger and said blade guard in any one of said many fixed positions of said handle frame on said roller frame includes first linkage means mounted for relative movement on said roller frame, adapted to engage said blade guard, and including a drive tab spaced a predetermined distance from said first tooth ring axis, and a linkage member supporting said trigger and mounted for pivotal movement on said handle frame about said second tooth ring axis between said extended and retracted positions of said trigger, said linkage member having a circular array of openings each adapted to receive said drive tab and afford driving engagement between said linkage member and said first linkage means.

* * * * *